US008182269B2

(12) United States Patent
Rancon

(10) Patent No.: US 8,182,269 B2
(45) Date of Patent: May 22, 2012

(54) ASSEMBLY FOR PRACTICING A GLIDING OR ROLLING SPORT

(75) Inventor: Henri Rancon, Lachenal (FR)

(73) Assignee: Salomon S.A.S., Metz-Tessy (FR)

( * ) Notice: Subject to any disclaimer, the term of this patent is extended or adjusted under 35 U.S.C. 154(b) by 845 days.

(21) Appl. No.: 12/257,516

(22) Filed: Oct. 24, 2008

(65) Prior Publication Data

US 2009/0111079 A1 Apr. 30, 2009

(30) Foreign Application Priority Data

Oct. 25, 2007 (FR) ..... 07 07491

(51) Int. Cl.
*A63B 69/18* (2006.01)
*A63C 9/00* (2006.01)

(52) U.S. Cl. ..... 434/253; 280/626

(58) Field of Classification Search ..... 434/247, 434/253; 280/611, 613, 618, 623, 624, 626, 280/628, 637
See application file for complete search history.

(56) References Cited

U.S. PATENT DOCUMENTS

| | | | | |
|---|---|---|---|---|
| 3,944,237 | A * | 3/1976 | Teague, Jr. | 280/618 |
| 6,089,581 | A | 7/2000 | Partridge | |
| 6,786,502 | B2 * | 9/2004 | Carlson | 280/633 |
| 7,222,864 | B2 * | 5/2007 | Giering, Jr. | 280/14.22 |
| 7,275,755 | B2 | 10/2007 | Marion | |
| 7,887,083 | B2 * | 2/2011 | Zaloom et al. | 280/624 |
| 2002/0135157 | A1 * | 9/2002 | Kruajitch | 280/607 |
| 2003/0116931 | A1 | 6/2003 | Quattro et al. | |
| 2004/0084878 | A1 | 5/2004 | Adamczewski | |
| 2004/0135347 | A1 | 7/2004 | Marion | |
| 2004/0150190 | A1 | 8/2004 | Marion et al. | |
| 2007/0170694 | A1 | 7/2007 | Adamczewski et al. | |
| 2008/0030000 | A1 | 2/2008 | Zaloom et al. | |
| 2008/0030001 | A1 | 2/2008 | Zaloom et al. | |

FOREIGN PATENT DOCUMENTS

| | | | |
|---|---|---|---|
| FR | 2 791 268 | A1 | 9/2000 |
| WO | WO-03/051472 | A1 | 6/2003 |
| WO | WO-2008/008261 | A2 | 1/2008 |

OTHER PUBLICATIONS

Anonymous: "ISPO 2007 product review" Onboard Global Snowboarding, [Online] Feb. 9, 2007, XP002515870, extract from the Internet: URL:http://onboardsnowboarding.com . . . .

Burton: "Burton 08 Men's and Women's Hardgoods" 08 Dealerbook, Feb. 6, 2007, XP002515871, ISPO 2007.

Anonymous: "ISPO review 5: Burton snowboards" Snowbroader, [Online] Feb. 8, 2007, XP 002515872, extract from the Internet: URL:http://snowbroader.wordpress.com . . . .

"SIA: Burton annouces [sic] new E.S.T. and Supreme Heat—A heated women's snowboard boot," Nollie Extreme Girls, [Online], Feb. 6, 2007, XP-002485015, pp. 1, 2.

U.S. Appl. No. 12/257,508 (Henri Rancon), filed Oct. 24, 2008.

* cited by examiner

*Primary Examiner* — Kurt Fernstrom
(74) *Attorney, Agent, or Firm* — Greenblum & Bernstein, P.L.C.

(57) ABSTRACT

An assembly provided for the practice of a gliding, rolling, or walking sport, such as snowboarding, skateboarding, or snowshoeing, for example, the assembly including a device for receiving a foot or a boot, as well as a board. The assembly includes a system for marking the position of the receiving device with respect to the board (3), the marking system including a first marking arrangement associated with the receiving device, as well as a second marking arrangement associated with the board, the first and second marking arrangements being provided to cooperate with one another.

17 Claims, 9 Drawing Sheets

60
1
55
56
57
2
53
42
54
170
171
76
10
Lo
II
47
59
62
58
44
41
46
18
5
61
17
22
19
21
82
7
63
45
9
4
3
71
64
69
6
70
172
8
15
43
16
81
85
150
II

Lo
71
171
170
1
172
115
4
3
L1
117
114
15
5
18
150

170
115
172
71
4
Lo
171
1
3
L1
117
114
150
15
5
18

252
W1
264
L1
-50 -40 -30 -20 -10 0 +10 +20 +30 +40 +50
265
-50 -40 -30 -20 -10 0 +10 +20 +30 +40 +50
266

Lo
71
251
254
176
Wo
C3
175

70

Lo

265
L1
Wo
C3
252
266
70

ASSEMBLY FOR PRACTICING A GLIDING OR ROLLING SPORT

CROSS-REFERENCE TO RELATED APPLICATION

This application claims priority under 35 U.S.C. §119 of French Patent Application No. 07 07491, filed on Oct. 25, 2007, the disclosure of which is hereby incorporated by reference thereto in its entirety.

In addition, this application is related to U.S. Patent Application Publication No. 2009/0111079, the disclosure of which is hereby incorporated by reference thereto in its entirety.

BACKGROUND OF THE INVENTION

1. Field of the Invention

The invention relates to assemblies intended for the practice of a gliding, rolling, or walking sport. More specifically, the invention relates to a device for receiving a foot or a boot, as well as to a gliding board or rolling board, for example, provided to receive the device.

Assemblies according to the invention are to be used for snowboarding, snow skiing, waterskiing, snowshoeing, skateboarding, wakeboarding, and the like.

2. Description of Background and Other Information

Generally speaking, each device of an assembly for receiving a user's foot or boot affects the steering of the board on which such device is mounted, because it transmits steering forces or receives sensory information between the foot or the boot and the board. This is why the device must have predetermined characteristics. For example, the receiving device must be affixed to the board at the desired location, and must transmit the steering impulses or the sensory information with accuracy.

In snowboarding, it is known to retain the two feet of the user on the same board. The receiving devices are arranged so that the feet are oriented along a transverse direction of the board, i.e., not parallel to the longitudinal axis of the board. Thus, the toes are located in the area of one edge of the board, whereas the heels are located in the area of the opposite edge.

In order to take into account the characteristics specific to each user, such as the height, weight, shoe size, experience, and steering style, an arrangement is typically provided so that the position of the feet with respect to the board is adjustable. In practice, this implies adjusting the position of the receiving devices on the board.

Conventionally, a receiving device, or retaining device, includes a baseplate adapted to be positioned between the boot and the board. The baseplate includes a circular through opening that receives a retaining disk. The baseplate and the disk have complementary teeth for angular adjustment, i.e., stepwise adjustment, of one with respect to the other. The disk has parallel slots that are provided to allow screws to extend therethrough for fixing the receiving device to the board. The slots of the disk make it possible, when the screws are loosened, to displace the disk relative to the board. Consequently, the position of the receiving device can be adjusted with respect to the board, over a range corresponding to the length of the slots, on the one hand, and rotationally as mentioned, on the other hand.

In addition, the board has one or several rows of threaded holes adapted to receive the retaining screws of the devices. The rows are oriented along the length of the board. The user adjusts the lengthwise position of each device by appropriately selecting the particular holes within the rows.

Finally, it is possible to adjust the position of each device with respect to the board, in the longitudinal direction and transverse direction, i.e., translationally as well as rotationally.

However, it appears that it is relatively difficult to position the devices, even if only to find the locations that are suited to a given user. In this regard, indeed, each device must be placed on the board, such that the slots of the disk face a group of threaded holes. This makes it possible to tighten the screws. The selection of a group is not obvious, as it is usually necessary to perform a plurality of positioning tests. Thus, a first position is selected for each device. If such position is not correct for the device, it must be modified by removing the screw, selecting another position, and then reinserting the screw. These manipulations are difficult, in the sense that one must proceed by trail and error to position each screw, because the disk masks the threaded holes. Moreover, when the screws are in place, there is still a freedom of translational adjustment, corresponding to the travel of the screws in the slots. There is also a freedom of rotational adjustment, which corresponds to a rotational movement of the baseplate with respect to the disk. It is generally necessary to end the positioning by loosening the screws, displacing the devices, and then retightening the screws. The positioning is empirical, in the sense that it is generally not possible to find the correct locations directly.

Therefore, it appears impossible to achieve correct positioning at the first attempt with known receiving devices. Several attempts are generally necessary to find a position that is adapted to the user. In other words, positioning is inaccurate.

Furthermore, positioning is time-consuming, because of the manipulation of the screws, which often have to be completely loosened and removed before being screwed back into the holes, on the one hand, and because of the need for the user to evaluate the location of a device on the board each time, on the other hand.

Generally speaking, it can be said that locating an appropriate position for a device of an assembly according to the prior art is complicated.

SUMMARY OF THE INVENTION

In view of the above, the invention simplifies locating an appropriate position for a device on board.

In addition, the invention facilitates the positioning of the device. This means making it possible to find the correct position immediately, which is the one suited to the user. The invention reduces the time required for the positioning.

To these ends, the invention is directed to an assembly for the practice of a gliding or rolling sport, the assembly including a device for receiving a foot or a boot, as well as a board.

The assembly according to the invention includes a system for marking the position of the receiving device with respect to the board, the marking system including a first mark associated with the receiving device, as well as a second mark associated with the board, the first and second marks being provided to cooperate with one another.

The first mark moves with respect to the second mark when a device moves on the board. It is possible to position one mark selectively with respect to the other. The positioning of one mark causes the positioning of the receiving device. Consequently, the invention makes it possible to find a suitable position immediately.

Simplified positioning is one of the resulting advantages. Compared to the prior art, it is indeed simpler to obtain the suitable position. Positioning is easier, especially because it avoids a number of adjusting or immobilizing manipulations. The invention makes it possible to immediately find a location, or position that is adapted to the needs of the user. In addition, the invention significantly reduces the time required for obtaining this location.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

Although the embodiments described hereinafter relate more particularly to snowboarding, it is to be understood that they also apply to other fields, as mentioned hereinabove.

A first embodiment is illustrated in FIGS. 1 to 10.

Figure 1:
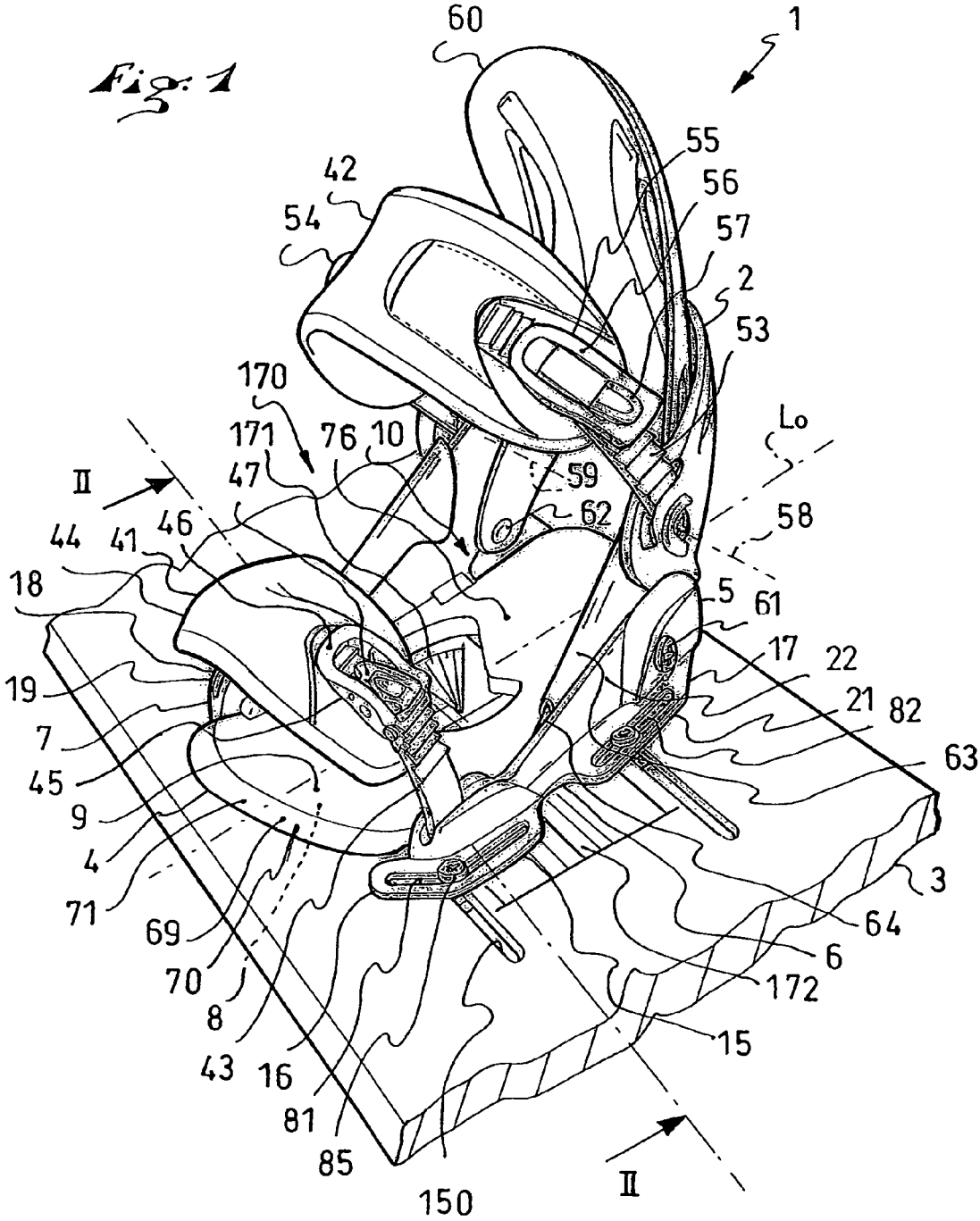
FIG. 1 is a perspective view of an assembly including a receiving device according to a first embodiment of the invention.

As shown in FIG. 1, an assembly 1, provided for the practice of snowboarding, includes a device 2 for temporarily receiving a boot on a board 3. The receiving device 2 is part of a snowboard binding, or retention assembly.

Generally speaking, the receiving device 2 has a length longitudinally extending in a direction Lo, from a front portion 4 to a rear potion 5, and, transversely, along a direction Wo, from a first side 6, or lateral side, to a second side 7, or medial side. The receiving device 2 further has a bottom portion 8, adapted to be positioned above the board 3, opposite a top portion 9. The boot is adapted to be received on the top portion 9, between the sides 6, 7, in a receiving zone 10.

The receiving device 2 includes a lateral longitudinal portion 15 that extends from a first end 16, or front end, to a second end 17, or rear end. The lateral longitudinal portion 15 is provided to extend along a lateral portion of the boot. Similarly, the device 2 includes a medial longitudinal portion 18 that extends from a first end 19, or front end, to a second end 20, or rear end. The medial longitudinal portion 18 is provided to extend along a medial portion of the boot.

Figure 2:
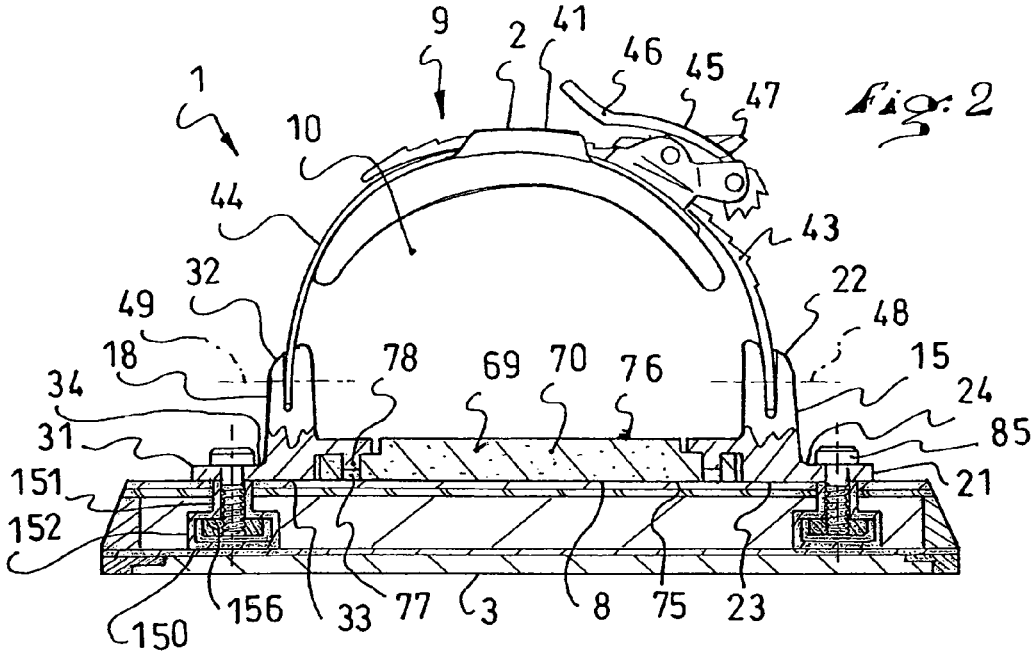
FIG. 2 is a cross-sectional view taken along the line II-I of FIG. 1.

As shown more clearly in FIG. 2, each longitudinal portion 15, 18 is provided to be supported on the board 3. Although the support is direct, according to the first embodiment, an indirect support could alternatively be provided, for example by means of a plate.

According to the first embodiment of the invention, and in a non-limiting manner, the lateral longitudinal portion 15 includes a lateral mounting base 21 connected to a lateral flange 22. The mounting base 21 has a bottom portion 23 that is opposite a top portion 24. The bottom portion 23 of the mounting base 21 partially forms the bottom portion 8 of the receiving device. The flange 22 rises from the top portion 24 of the mounting base 21. The transverse cross section of the longitudinal portion 15 has the shape of an angle bracket, the arrangement of which positions the flange 22 on the side of the receiving zone 10. Therefore, it is the flange 22 that extends along the boot. In other words, the mounting base 21 extends outward of the receiving zone 10, with respect to the flange 22.

Similarly, the medial longitudinal portion 18 includes a medial mounting base 31 connected to a medial flange 32. The mounting base 31 has a bottom portion 33 that is opposite a top portion 34. The bottom portion 33 of the mounting base 31 also partially forms the bottom portion 8 of the receiving device 2. The flange 32 rises from the top portion 34 of the mounting base 21. Here again, the transverse cross section of the longitudinal portion 18 has the shape of an angle bracket, the arrangement of which positions the flange 32 on the side of the receiving zone 10. Therefore, it is the flange 32 that extends along the boot. In other words, the mounting base 31 extends outward of the receiving zone 10, with respect to the flange 32.

As further explained below, the lateral 15 and medial 18 longitudinal portions are provided to be fixed to the board 3.

Meanwhile, FIGS. 1 and 2 illustrate how the boot is reversibly retained in the receiving zone 10.

As is well known to one of ordinary skill in the art, the receiving device 2 includes a first linkage 41, or front linkage, as well as a second linkage 42, or rear linkage, which are provided to retain the boot in the retaining zone. To this end, each of the linkages 41, 42, or straps, extends between the lateral longitudinal portion 15 and the medial longitudinal portion 18. This particular number of linkages/straps is not mandatory, as one could instead provide only one or more than two linkages/straps.

The first linkage 41 includes a lateral portion 43, a medial portion 44, and a reversible tightening mechanism 45. The reversible tightening mechanism is provided, for example, with a tightening lever 46 and a release button 47. Thus, the linkage 41 can be tightened or loosened at will, and can even be completely open. The lateral portion 43 is connected to the longitudinal portion 15, more particularly to the flange 22, by means of an articulation having an axis 48. Similarly, the medial portion 44 is connected to the longitudinal portion 18, to the flange 32, by means of an articulation about an axis 49.

This enables the first linkage 41 better to lie flat against the boot upper when being tightened or, conversely, to better free itself when the boot is being put on or removed.

Similarly, the second linkage 42 also includes a lateral portion 53, a medial portion 54, and a reversible tightening mechanism 55. The latter is provided, for example, with a tightening lever 56 and a release button 57. Thus, the linkage 42 can be tightened, loosened, or left open. The lateral portion 53 is connected to the longitudinal portion 15 by means of an articulation about an axis 58, and the medial portion 54 is connected to the longitudinal portion 18 by means of an articulation about an axis 59. This enables the second linkage 42, as the case may be, to lie flat or to free itself with respect to the boot.

Further, the receiving device 2 includes a rear support element 60, or highback, provided to support the user's lower leg rearwardly. The support element 60 is connected to the lateral longitudinal portion 15, for example by means of a lateral articulation 61, as well as to the medial longitudinal portion 18, for example by means of a medial articulation 62. This arrangement enables the rear support element to be pivoted forwardly to reduce the space requirement during storage. The rear support element 60 also contributes to the cohesion of the device 2, because it connects the longitudinal portions 15, 18 to one another.

Furthermore, an abutment 63 is provided to limit rear movement of the support element 60. The abutment 63 includes a linkage 64 that is attached to the lateral longitudinal portion 15 and to the medial longitudinal portion 18, and which extends around the support element 60. This is a sort of stayed retention. Alternatively, the abutment could include a mounting base that is adjustably fixed to the support element 60.

The receiving device 2 further includes a seat 69 provided to receive the boot sole. The seat 69 is to be understood as being an element that can include one or several superimposed layers.

According to the first embodiment of the invention, and in a non-limiting manner, the seat 69 includes a single layer constituted, for example, by means of a pad 70. Embodiments having a plurality of layers are described below.

The receiving device 2 further includes a pad 70 provided to receive the sole of the boot. As can be understood by means of FIGS. 2 and 3, the pad extends lengthwise along the longitudinal direction 20 of the device, from a front end 71 to a rear end 72, and widthwise, from a lateral edge 73 to a medial edge 74. Thicknesswise, the pad 70 has a bottom portion 75 that is opposite a top portion 76. The bottom portion 75 is opposite the board 3, and the top portion 76 receives the sole of the boot. The front end 71 is part of the front portion 4 of the device 2, and, similarly, the rear portion 72 is part of the rear portion 5 of the device. Similarly, the bottom portion 75 is part of the bottom portion 8 of the device 2, together with the bottom portions 23, 33 of the mounting bases 21, 31 of the longitudinal portions 15, 18.

The lateral 73 and medial 74 edges of the pad 70 are removably affixed to the lateral 15 and medial 18 longitudinal portions, respectively, of the device 2. For example, the pad 70 has openings 77 that are distributed in four groups. In fact, the pad 70 includes four lines of openings 77, two of which are located toward the lateral edge 73, and the other two toward the medial edge 74. Pins 78 originating from the longitudinal portions 15, 18 are provided to be inserted into the openings 77. Moreover, selecting the openings 77 and the pins 78 enables adjustment of the longitudinal position. This adjustment is non-continuous, i.e., incremental. A continuous adjustment could also be obtained.

Figure 3:
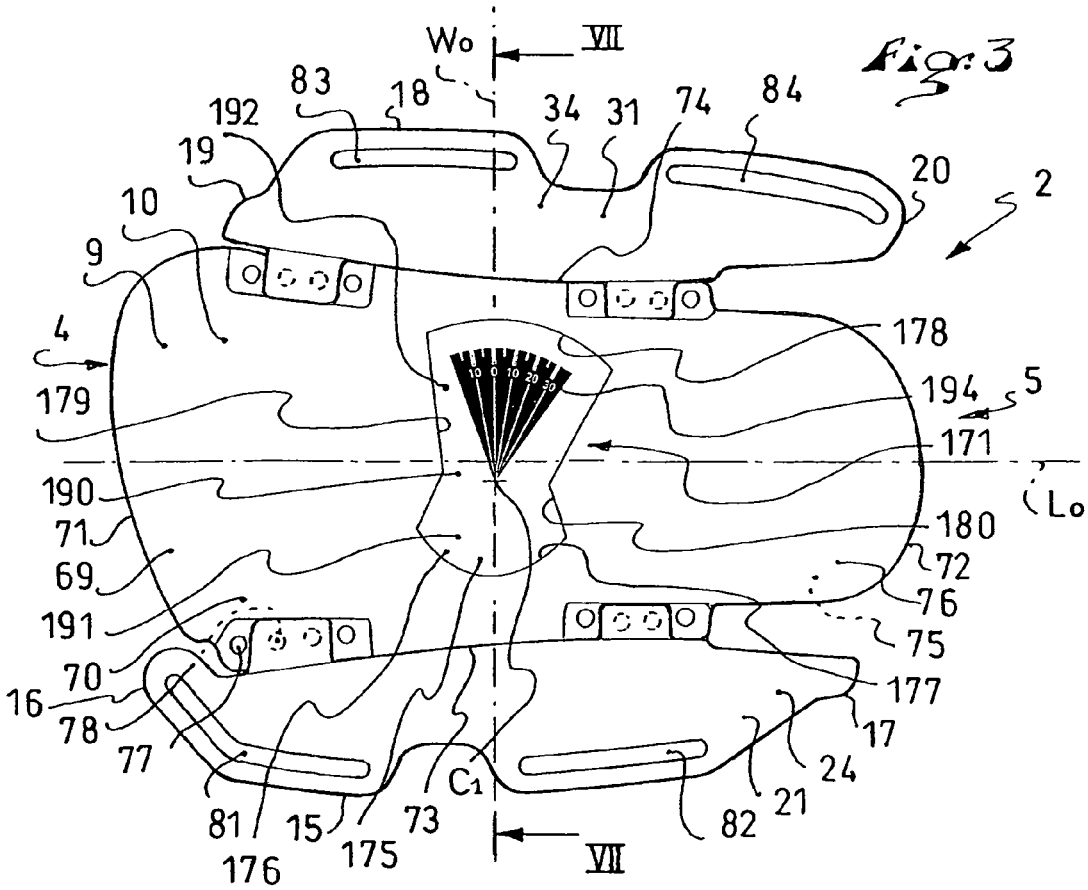
FIG. 3 is a partial schematic top view of the receiving device.

As seen particularly in FIG. 3, the lateral longitudinal portion 15 has a first lateral slot 81 toward the first end 16, as well as a second lateral slot 82 toward the second end 17. The medial longitudinal portion 18 has a first medial slot 83 toward the first end 19, as well as a second medial slot 84 toward the second end 20. The slots 81, 82, 83, 84 are provided for the passage of members 85 for fixing the receiving device 2 to the board 3, each member 85 being provided to cooperate with the board. The lateral slots 81, 82 can be regarded as part of a lateral attachment arrangement to fix the lateral longitudinal portion 15 to the board, and the medial slots 83, 84 can be regarded as part of a medial attachment arrangement to fix the medial longitudinal portion 18 to the board.

In the illustrated embodiment, each member 85 includes a screw having the same reference numeral. When a screw 85 is not tightened, it can slide in the slot through which it extends. Consequently, the position of the receiving device 2 is slidably adjustable on the board. The adjustment is continuous, which enables highly accurate positioning.

Generally speaking, the slots 81, 82 and 83, 84 are arranged in the lateral 21 and medial 31 mounting bases of the longitudinal portions 15, 18, respectively. Thus, the slots 81, 82, and 83, 84 are farther away from the receiving zone 10 than the flanges 22, 32. This arrangement enables, among other things, a better transmission of the steering forces and sensory information.

According to the first embodiment of the invention, each slot is level with a linkage. However, for the front linkage 41, or first linkage 41, the first lateral slot 81 is farther forward than the first medial slot 83. Also, for the rear linkage 42, or second linkage, the second lateral slot 82 is further farward than the second medial slot 84. Thus, the arrangement of the slots 81 to 84 is non-symmetrical transversely, i.e., with respect to the longitudinal direction Lo. In other words, the lateral 81, 82 slots and the medial slots 83, 84 do not transversely face one another, respectively. This arrangement enables easier positioning of the device 2 on the board.

How the receiving device 2 is affixed to the board 3 will next be described.

Figure 4:
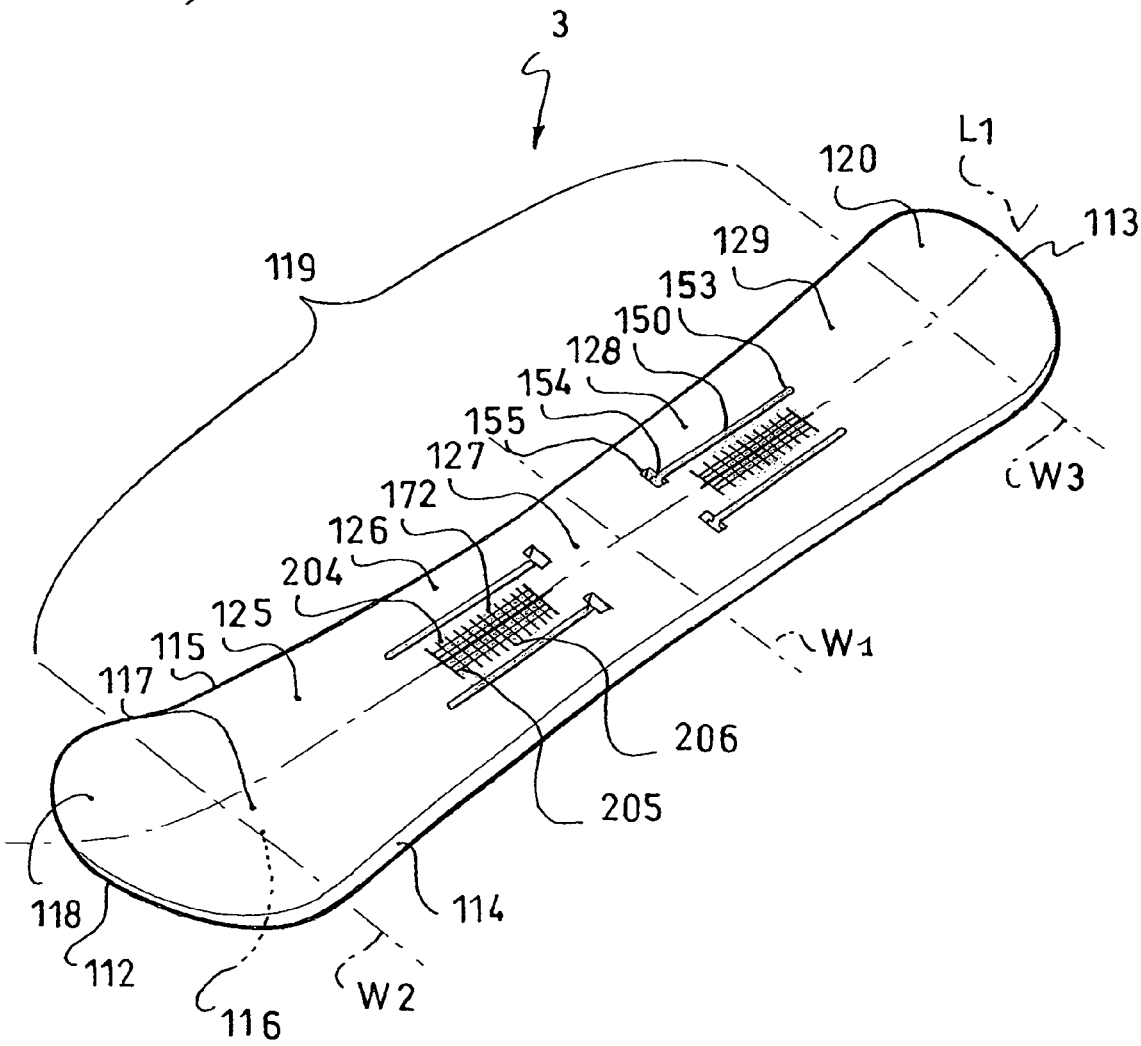
FIG. 4 is a perspective view of a board of the assembly.

According to the first embodiment, as seen particularly in FIG. 4, the board 3 has a length that is measured along a longitudinal direction, between a first end 112, or tip or front end, and a second end 113, or tail or rear end. The longitudinal direction is referenced by means of the central longitudinal axis L1. The first 112 and second 113 ends are each rounded, but could alternatively have a different shape, such as that of a pointed tip or that of a fin. The board 1 also has a width measured along a transverse direction W1, between a first lateral edge 114, or side, and a second lateral edge 115, or side, as well as a height, or thickness, measured between a bottom portion 116, i.e., the base or gliding surface, and a top portion 117, or receiving surface.

The direction W1 is transverse to and, more particularly, perpendicular to the longitudinal direction L1, and parallel with respect to the gliding surface 6.

The board 3 also has, from the first end 112 to the second end 113, a first end zone 118, a first contact line W2, a central zone 119, a second contact line W3, and a second end zone 120. The central zone 119 itself successively includes, between the contact lines W2 and W3, a first intermediate zone 125, a first retaining zone 126, a second intermediate zone 127, a second retaining zone 128, and a third intermediate zone 129. The end 118, intermediate 125, retaining 126, intermediate 127, retaining 128, intermediate 129, and end 120 zones follow one another longitudinally.

Each retaining zone 126, 128 is provided to receive a receiving device 2. To this end, as can be understood particularly by means of FIGS. 2 and 4, each retaining zone 126, 128 is provided with sliding rails 150. Given that the latter are all identical, or similar, only one of them is described hereinafter. With particular reference to FIG. 2, a sliding rail 150, housed within the structure of the board and designed to open outwardly, i.e., to the top portion 117 of the board, includes a narrow hollow portion 151 extended by a widened hollow portion 152. The arrangement of the portions 151, 152 provides the sliding rail 150 with a T-shaped cross section. The portions communicate with one another. The sliding rail 150 is arranged such that the narrow portion 151 opens out at the surface of the board 3, i.e., on the side of the receiving surface 117. The widened portion 152 is housed within the board structure.

The sliding rail 150 is made, for example, from an extruded material, such as aluminum.

Lengthwise, the sliding rail 150 extends from a first end 153 to a second end 154. The end 154 opens out on an inlet 155 that is at least as wide as the widened portion 152. This enables a screw nut 156 to be inserted in the widened portion. The attachment member, or screw 85, extends through a slot 81, 82, 83, 84 of the receiving device 2, then through the narrow portion 151 of the sliding rail 150, in order to become threaded within the nut 156 housed in the widened portion 152. Consequently, tightening the screw 85 makes it possible to immobilize the receiving device 2 with respect to the board 3, whereas loosening allows it to slide along the board, parallel to the board.

In addition, the first retaining zone 126 of the board 3 includes two sliding rails 150, and that the second retaining zone 128 also includes two sliding rails 150. In each zone 126, 128, the sliding rails 150 are parallel to one another. They are transversely spaced apart by a distance comprised between 50 and 220 mm. For example, a distance between 90 and 120 mm is suitable. The sliding rails 150 are also oriented along the longitudinal direction L1 of the board 3. As further described below, this facilitates a longitudinal displacement of the device 2. Furthermore, two sliding rails 150 of the same zone (126 or 128) are transversely opposite one another. This enables the same position adjustments, depending upon whether the user is right-handed or left-handed. More specifically, the same adjustments are achieved if the direction in which the receiving devices 2 are oriented is transversely inverted, by switching the front 4 and rear 5.

According to the invention, the assembly 1 includes a system 170 for marking the position of the receiving device 2 with respect to the board 3, the marking system 170 including a first marking arrangement 171 associated with the receiving device 2, as well as a second marking arrangement 172 associated with the board 3, the first and second marking arrangements being provided to cooperate with one another.

In practice, the first marking arrangement 171 is positioned relative to the second marking arrangement 172, or vice versa. The cooperation of the marking arrangements 171, 172 enables a simple, easy, and quick positioning of the receiving device 2 on the board 3. Indeed, a reading is sufficient to allow the position of the device to be known. This reading provides the user with general information, i.e., information regarding the translational and/or rotational positions.

According to the first embodiment, and in a non-limiting manner, the first marking arrangement 171 is obtained by making an opening 175 in the seat 69 and by arranging a window 176 in the area of the opening. The window 176 is provided with a scale having graduations. Actually, the opening 175 extends through the thickness of the seat 69 or the pad 70, from the bottom portion 75 up to the top portion 76. The opening 175 is a passage that makes it possible to see through the pad 70. In this embodiment and other exemplary embodiments, then, it can be said that the second marking arrangement 172 is superposed with respect to the first marking arrangement 171.

As shown in FIG. 3, the opening 175 is located substantially half-way between the front end 71 and rear end 72, and substantially half-way between the lateral edge 73 and the medial edge 74. The opening 175 extends lengthwise from a first end 177, located toward the lateral edge 73, to a second end 178, located toward the medial edge 74. The opening 175 extends widthwise from a front edge 179, turned toward the front end 71, to a rear edge 180, turned toward the rear end 72. The general appearance of the opening 175 is that of a non-symmetrical diabolo. Thus, the opening 175 has a narrowed center 190, which is extended toward the lateral edge 73 by a first widening 191, and toward the medial edge 74 by a second widening 192.

Figure 7:
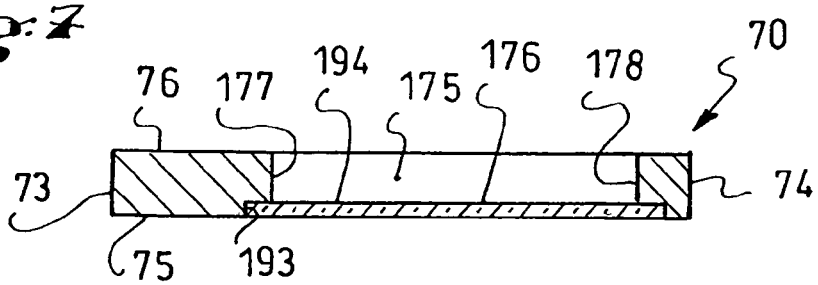
FIG. 7 is a partial cross-sectional view taken along the line VII-VII of FIG. 3.

The shape of the opening 175 is non-limiting, in that an opening having any of a number of different shapes can be utilized. Still by means of FIG. 3, but also FIG. 7, an example of the positioning of the graduated window 176 is shown. The window reproduces substantially the shape of the opening 175 on a slightly larger scale. The window 176 is therefore a bit longer and/or a bit wider than the opening. FIG. 7 shows that the opening 175 has a lower widening 193 in the area of the bottom portion 75 of the pad. This widening forms a housing for the window 176. The window is affixed to the pad 70 so as to be level with the bottom portion 75. For example, the window includes a transparent or translucent sheet made of a plastic material, the thickness of which can be between several tenths of millimeters and several millimeters.

The window is adhered in the opening 175 or, alternatively, embedded in or assembled to the pad, by any equivalent means.

Any of a number of means for affixing the window to the pad can be implemented. For example, the lower widening 193 is not mandatory. A window-forming sheet can extend over part of or the entire surface of the pad. Alternatively, the window can be positioned at any level in the depth of the pad, including toward the top portion 76.

The illustrated embodiment provides the bottom portion 75 with a geometric continuity and, as described additionally below, enables a highly accurate reading. This is due to the proximity of the window in relation to the board 3.

With reference specifically to FIG. 3, the window 176 bears a graduated scale 194. This means that the opening 175, the window 176, and the scale 194 form the first marking arrangement 171. The graduation 194 includes a center C1, from which the radii originate. A first radius is referenced by the number 0. This radius is oriented along the transverse direction Wo of the receiving device. Other radii, identified by numbers such as 10, 20, 30, are located on both sides of the first radius. This means that the angular offset from one radius to the next is ten degrees. Thus, the graduated scale 194 is similar to a protractor.

Positioning the graduations of the scale 194 on the window is carried out by any means, such marking, etching, or the like.

One can also provide a self-supported, or self-contained, graduated scale, which can be arranged independently on the opening, in the opening, or associated with the window. For example, the graduation can be provided in the form of a lattice or an interlacing arranged in the area of the opening. In such a case, the graduated scale, as such, is arranged in the area of the opening. Consequently, the first marking arrangement is formed by the opening and the graduated scale.

Figure 5:
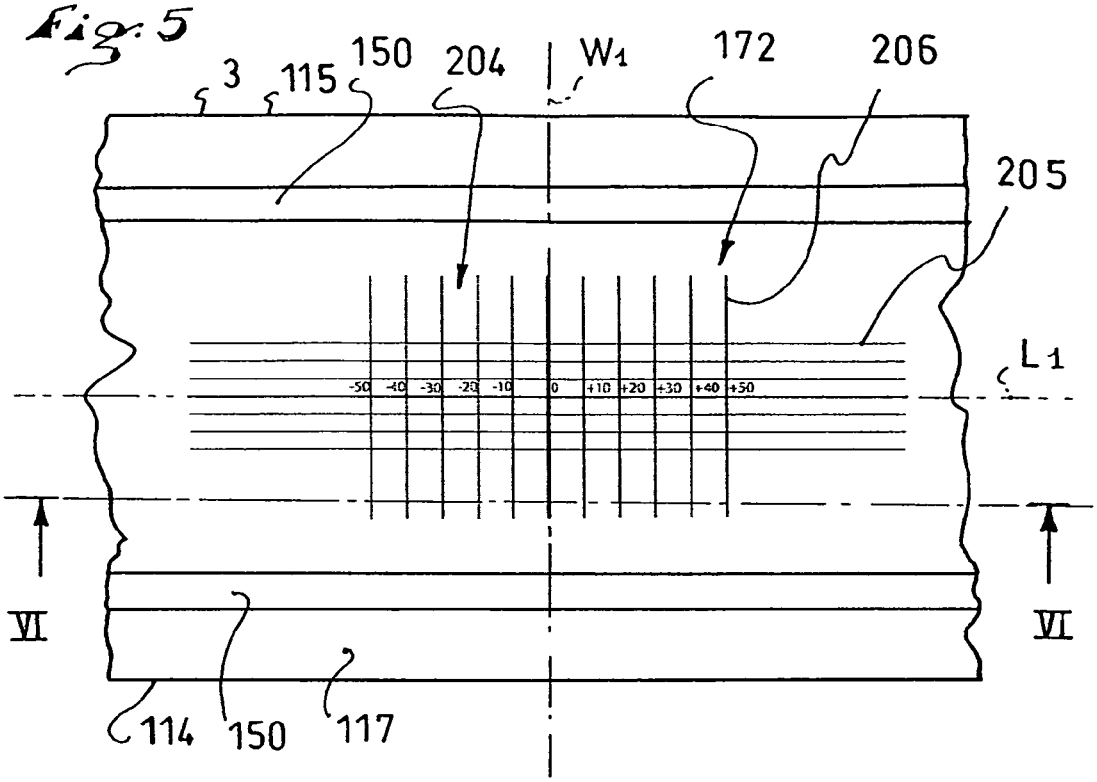
FIG. 5 is a partial top view of the board according to FIG. 4.
Figure 6:
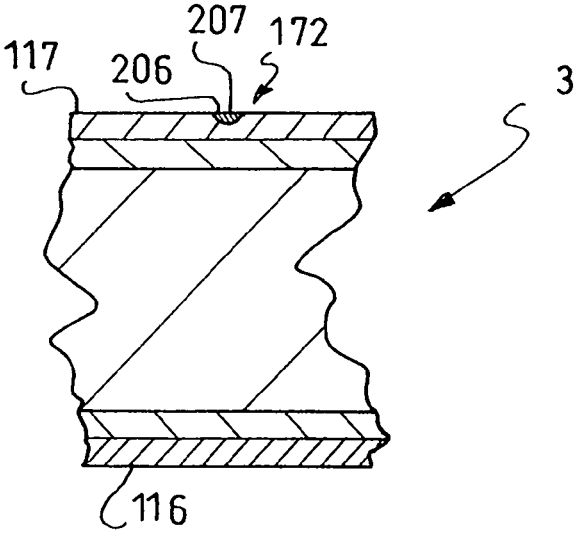
FIG. 6 is a partial cross-sectional view taken along the line VI-VI of FIG. 5.

The board 3 includes a second marking arrangement 172, shown by means of FIGS. 4 to 6, to cooperate with the first marking arrangement 171 of the receiving device.

Generally speaking, as shown in FIG. 5, the second marking arrangement 172 includes a graduated scale 204 arranged on the board 3. The graduations of the scale includes longitudinal lines 205, oriented along the direction L1, as well as transverse lines 206, oriented along the direction W1. These lines 205, 206 are perpendicular with respect to one another and form a grid. The transverse lines 206 include a central line referenced by the number 0, as well as parallel lines referenced by the numbers 10, 20, 30, and so on, i.e., varying by increments of ten. The transverse lines are spaced apart by 10 mm, for example. Similarly, the longitudinal lines 205 include a central line, along the longitudinal direction L1, as well as parallel lines spaced apart, for example, by 5 or 10 mm.

The lines 205, 206 are arranged on the board 3 by any suitable means. According to FIG. 6, which is a partial cross section in the area of the central transverse line 206, a groove 207 filled with a filler material is provided. The groove 207 is arranged on the top portion 117 of the board. In other words, etchings combined with fillers make it possible to define the second marking arrangement 172. Alternatively, one can provide a simple mark using a means such as ink, paint, or any equivalent.

As shown particularly in FIG. 4, each marking arrangement 172 is arranged in a receiving zone 126, 128 and is visible on the top portion, or upper surface, of the board 3. More specifically, each marking arrangement 172 is located between two sliding rails 150, along the transverse direction W1.

Figure 8:
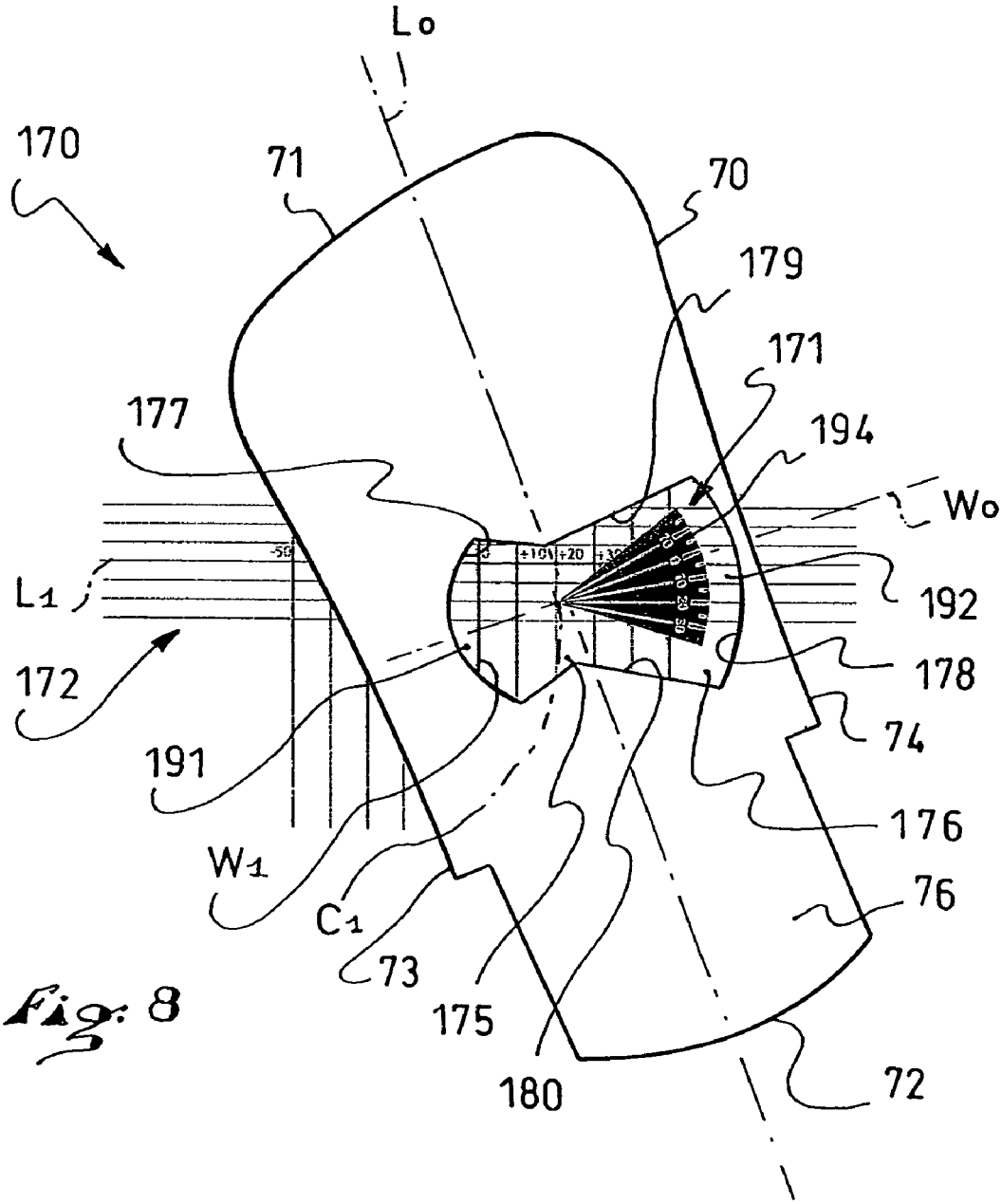
FIG. 8 is diagram showing a top view of a system for marking the position of the receiving device with respect to the board.
Figure 9:
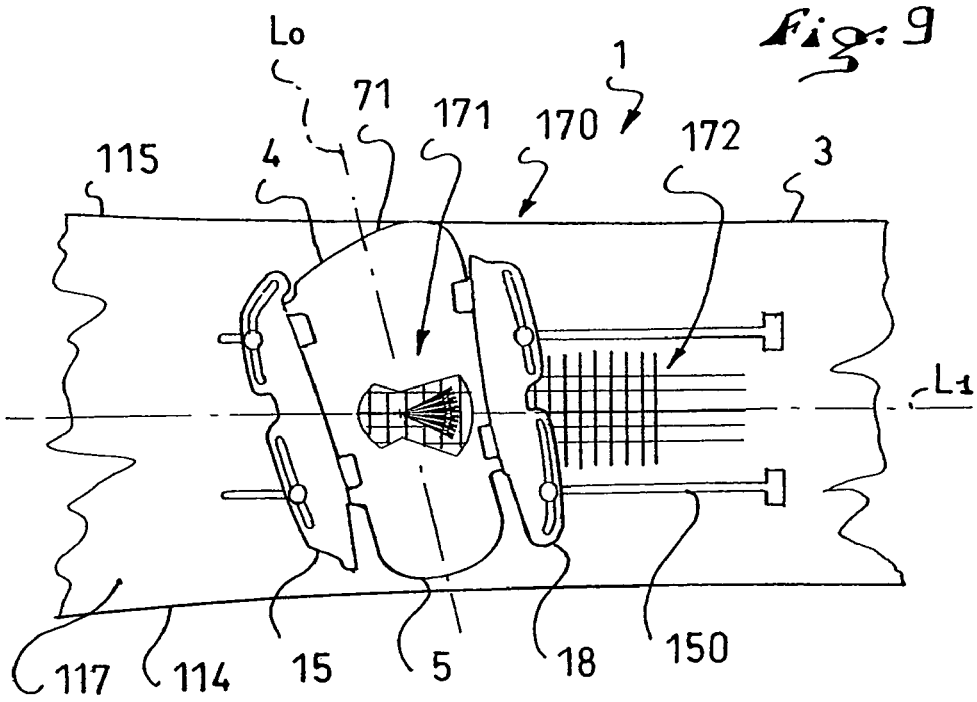
FIG. 9 is a schematic top view of the assembly, showing the receiving device in a first position on the board.
Figure 10:
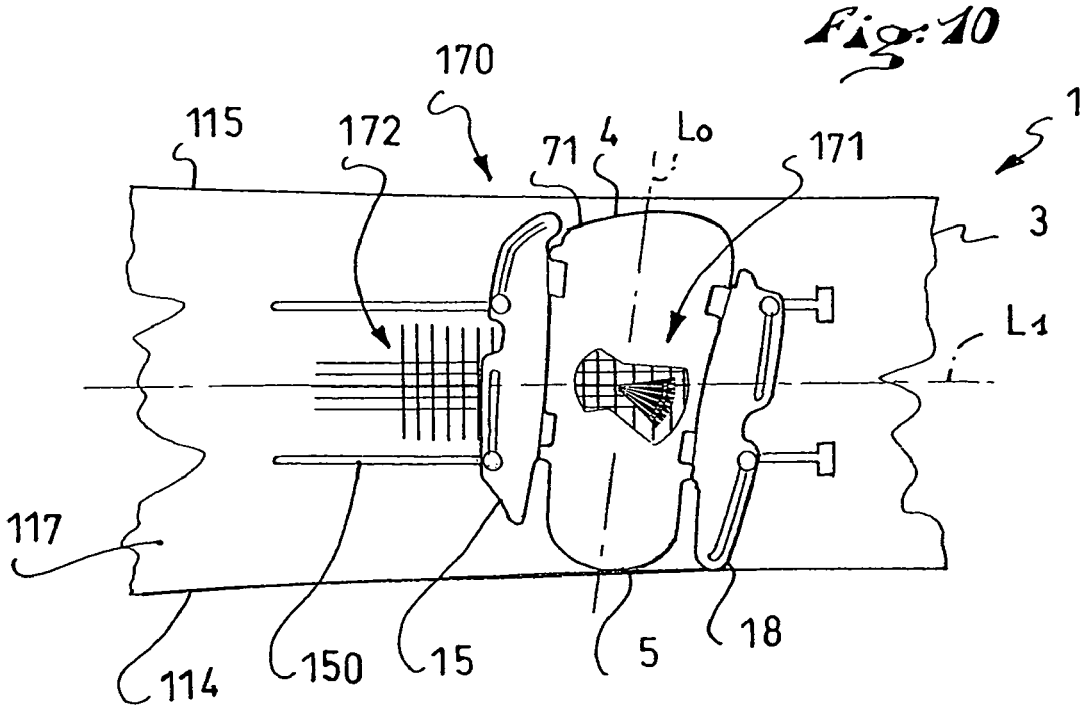
FIG. 10 is similar to FIG. 9, for a second position of the receiving device.

Finally, the positioning of a device 2 on the board 3 is carried out as can be understood by reference to FIGS. 8 to 10. If one were to consider that the screws 85 are loosened, the user can displace the device 2 along the sliding rails 150. To this end, FIG. 8 shows how well the first marking arrangement 171 cooperates with the second marking arrangement 172. The user positions the center C1 of the first marking arrangement 171 relative to the longitudinal 205 and transverse 206 lines of his choosing of the second marking arrangement 172. The positioning of C1 is a choice of position along the longitudinal L1 and transverse W1 directions of the board 3. Next, it is necessary to select the rotational position. To do this, one must keep C1 in a fixed position and turn the device 2 parallel with respect to the board 3. Selecting the angular position is carried out by aligning a radius of the first marking arrangement 171 with respect to a longitudinal line 205 of the second marking arrangement 172.

Thus, the possibilities of adjustment are numerous, and switching from one position to another is done in a continuous manner, as can be understood by means of FIGS. 9 and 10.

In FIG. 9, for example, the device 2 is in a position that is close to the first end 112 of the board and to the second lateral edge 115, along a given angular orientation. Conversely, in FIG. 10, the device 2 is further away from the first end 112 and closer to the first lateral edge 114, along another angular orientation. Switching from one position to another is made easier by the marking system. It is indeed simple to verify the selected adjustments, because the relative position of the marking arrangements 171, 172 can be read directly.

When a position of the device is determined, the screws 85 are tightened in order to immobilize the device 2 with respect to the board 3, and to thus enable operation of the assembly 1.

Other embodiments will now be described with reference to FIGS. 11 to 18. For reasons of convenience, only elements specific to these embodiments are shown and the elements that are common with the first embodiment are designated by the same reference numerals.

Figure 11:
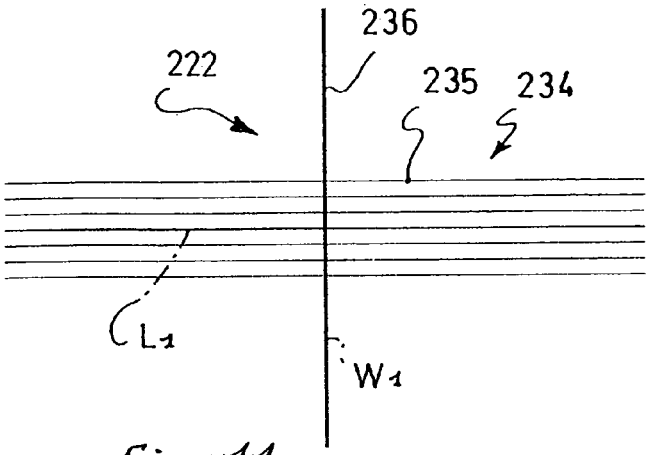
FIG. 11 is a diagram showing a top view of a mark associated with the board, for a second embodiment of the invention.
Figure 12:
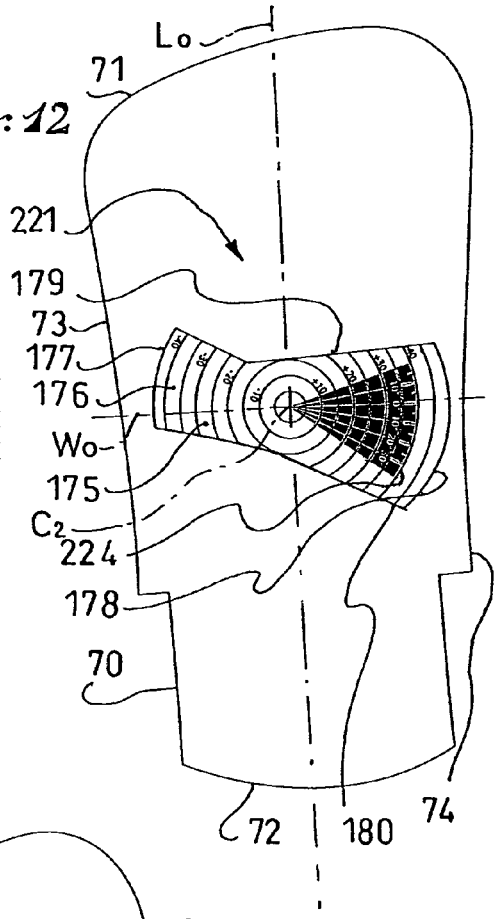
FIG. 12 is a diagram showing a top view of a mark associated with the receiving device, for the second embodiment of the invention.

A second embodiment is described hereinafter with reference to FIGS. 11 to 13.

A marking system 220 includes a first marking arrangement 221 associated with the receiving device 2, as well as a second marking arrangement 222 associated with the board 3.

The first marking arrangement 221 is formed by the opening 175 of the pad 70, the window 176, and a graduated scale 224. The opening 175, here also, extends lengthwise from the first end 177, located toward the lateral edge 73, to the second end 178, located toward the medial edge 74. The opening 175 extends widthwise from the front edge 179, turned toward the front end 71 of the pad 70, to the rear edge 180, turned toward the rear end 72.

The graduated scale 224 includes a center C2, from which radii originate. A first radius is referenced by the number 0. The radius is oriented along the transverse direction Wo of the receiving device. Other radii are located on both sides of the first radius and are identified by numbers such as 10, 20, 30, for an angular offset of ten degrees from one radius to another. The graduated scale 224 is thus similar to a protractor.

The graduated scale 224 further includes concentric circles having various radii and a center C2. For example, the radii vary by increments of 10 mm.

The second marking arrangement 222 includes a graduated scale 234 formed of longitudinal lines 235 oriented along the direction L1, and of a transverse line 236 oriented along the direction W1.

Figure 13:
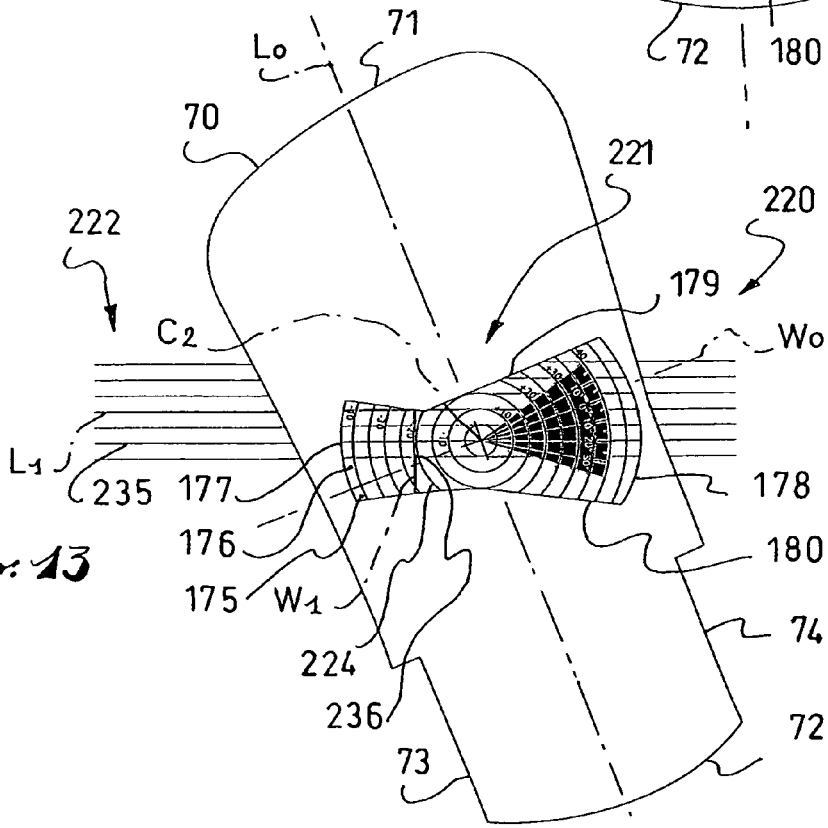
FIG. 13 is a diagram showing a top view of the marking system according to the second embodiment of the invention.

The positioning of a device 2 on the board 3 is carried out as can be understood with reference to FIG. 13. The center C2 is positioned in relation to a longitudinal line 235 in order to obtain the transverse position of the device. One of the concentric circles is positioned in relation to the transverse line 236 in order to obtain the longitudinal position of the device. A radius is oriented in relation to the longitudinal lines 235 in order to obtain the desired angular position.

Figure 14:
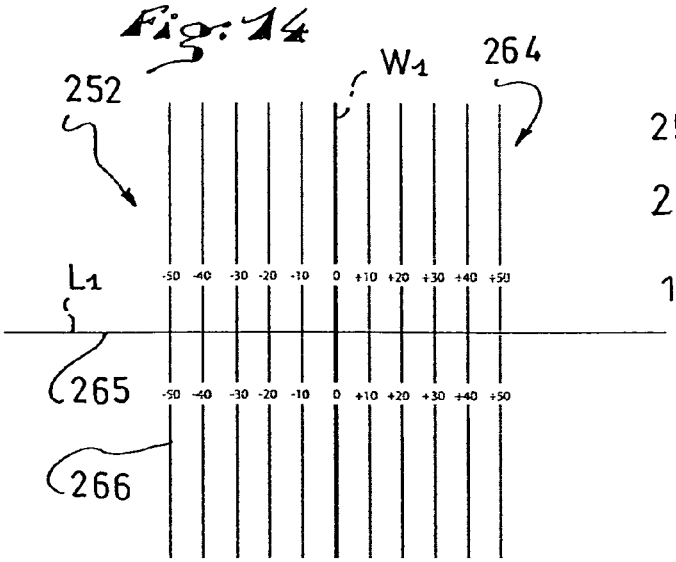
FIG. 14 is similar to FIG. 11, for a third embodiment of the invention.
Figure 15:
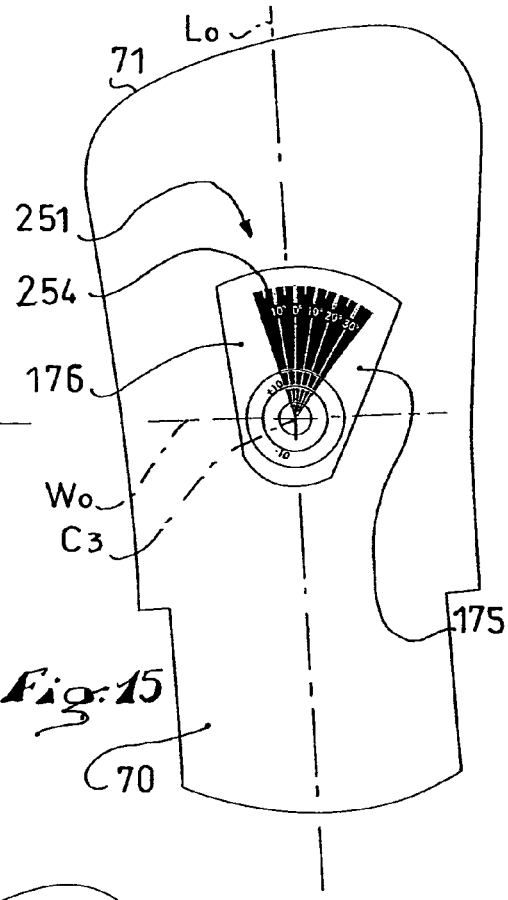
FIG. 15 is similar to FIG. 12, for the third embodiment of the invention.

A third embodiment of the invention is described hereinafter with reference to FIGS. 14 to 16.

A marking system 250 includes a first marking arrangement 251 and a second marking arrangement 252.

The first marking arrangement 251 is formed by the opening 175 of the pad 70, the window 176, and a graduated scale 254. Here, the opening is oriented differently, i.e., so as to cause the graduated scale 254 to pivot by 90 degrees with respect to the second embodiment.

The graduated scale 254 of the third embodiment has a center C3, from which radii originate. A first radius, referenced by the number 0, is oriented along the longitudinal direction Lo of the receiving device. Other radii identified by numbers are located on both sides of the first radius. The graduated scale 254 still plays the role of a protractor.

The graduated scale 254 also includes concentric circles having various radii and a center C3.

The second marking arrangement 252 includes a graduated scale 264 formed of a longitudinal line 265 oriented along the direction L1, as well as transverse lines 266 oriented along the direction W1.

Figure 16:
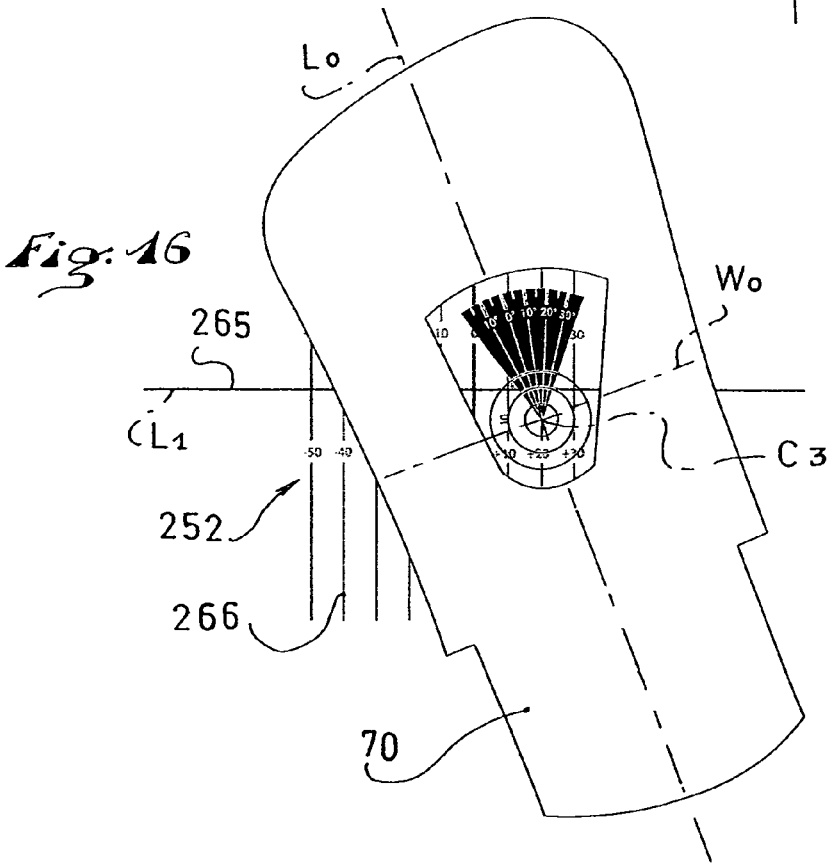
FIG. 16 is similar to FIG. 13, still for the third embodiment of the invention.

The positioning of a device 2 is carried out according to FIG. 16. A circle having a center C3 is positioned with respect to the longitudinal line 265 in order to obtain the transverse position of the device. The center C3 is positioned with respect to the transverse lines 266 in order to obtain the longitudinal position of the device. A radius is oriented with respect to the transverse lines 266 in order to obtain the desired angular position.

Figure 17:
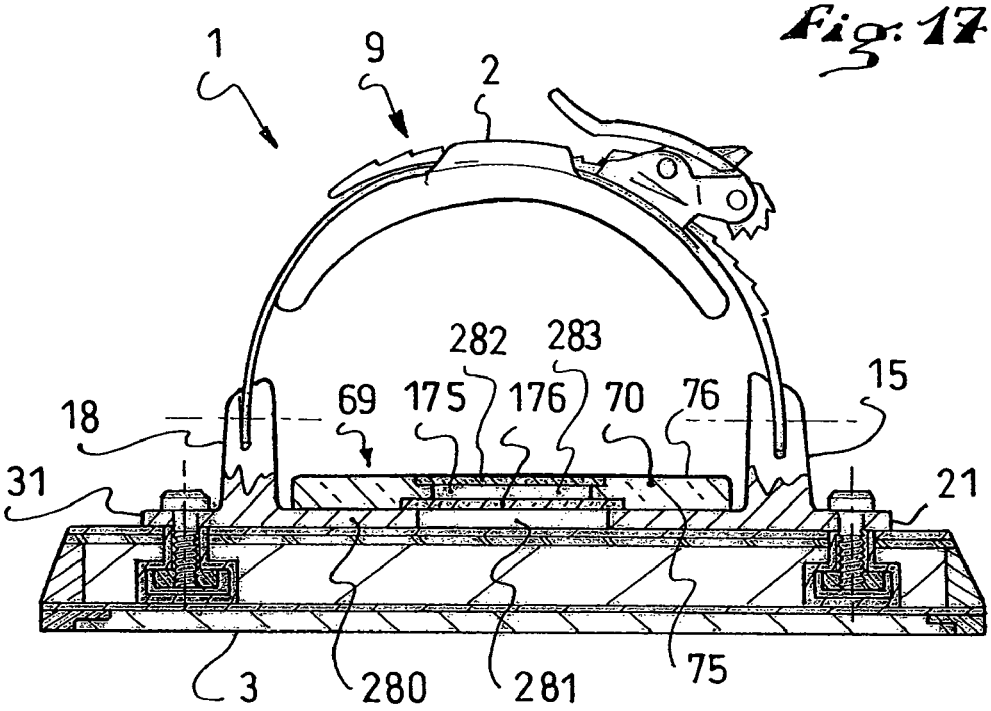
FIG. 17 is a cross section, similar to FIG. 2, according to a fourth embodiment of the invention.
Figure 18:
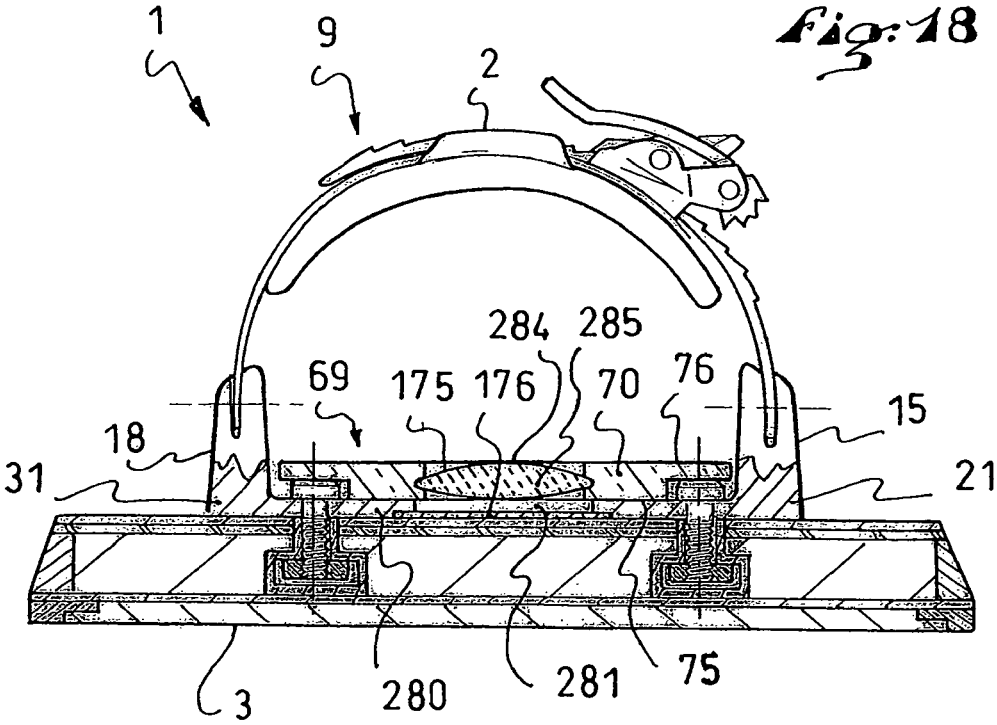
FIG. 18 is a cross section, similar to FIG. 2, according to a fifth embodiment of the invention.

Fourth and fifth embodiments are shown in FIGS. 17 and 18.

These two embodiments include an assembly 1, with a receiving device 2 and a board 3. Each assembly includes a lateral longitudinal portion 15 and a medial longitudinal portion 18.

A base 280 directly connects the longitudinal portions 15 and 18 to one another. More specifically, the base 280 extends the lateral 21 and medial 31 mounting bases to form a continuous bottom portion, which extends from the lateral side 6 to the medial side 7. This increases the rigidity of the device 2.

The seat 69 of the device 2 therefore has a multilayered structure, which includes the pad 70 and the base 280, the pad overlying the base. The pad 70 still has an opening 175, and the base 280 has an opening 281. The openings 175, 281 are at least partially facing one another, such that the board 3 is visible from the top portion 9.

According to the fourth embodiment of the invention, as can be understood with reference to FIG. 17, the window 176 is arranged in the area of the pad 70. More specifically, the window 176 is a first window, located in the area of the bottom portion 75. In addition, a complementary window 282 is located in the area of the top portion 76 of the pad 70. The windows 176, 282 demarcate boundaries of a closed volume 283 in the opening 175 of the pad. This prevents the opening 175 from possibly becoming clogged up with foreign bodies, in particular snow.

One or both windows 176, 282 can have edges for connecting to one another, thus forming a closed box.

Alternatively, as can be understood with reference to FIG. 18 for the fifth embodiment of the invention, the window 176 is arranged in the area of the base 280.

An optical device 284 is accessorily provided to cooperate with the window 176, i.e., in a broad sense, with the first marking arrangement 171, 221, 251. For example, and in a non-limiting manner, the optical device 284 includes a magnifying lens 285 housed in the opening 175. The magnifying lens 285 provides an enlarged view of the graduation of the window 176, with the object of improving reading comfort.

Generally speaking, the invention is embodied from materials and in according to implementation techniques known to one of ordinary skill in the art.

The invention is not limited to the embodiments described hereinabove, and encompasses all of the technical equivalents that fall within the scope of the claims that follow.

In particular, a window can partially or completely fill an opening.

An opening can be simple, as in the embodiments described, i.e., related to a single passage, or can be complex, i.e., formed of a plurality of passages.

A pad and/or a base made of an at least partially transparent or translucent material can be provided for reading, through its thickness, the marking arrangement that is associated with the board. In this case, the pad and/or the base directly include the marking system associated with the receiving device.

The invention claimed is:

1. An assembly for the practice of a gliding or a rolling sport, said assembly comprising:

a board elongated in a longitudinal direction;

a receiving device for receiving a foot or a boot, said receiving device adapted to be mounted on the board;

a system for marking a position of the receiving device with respect to the board, the marking system comprising a first marking arrangement associated with the receiving device and a second marking arrangement associated with the board;

the first and second marking arrangements being configured and arranged to cooperate with one another in marking the position of the receiving device at which the receiving device is to be mounted on the board;

the first marking arrangement comprising a first graduated scale;

the second marking arrangement comprising a second graduated scale;

one of the first and second marking arrangements being structured and arranged to be superposed with respect to another of the first and second marking arrangements.

2. An assembly according to claim 1, wherein:

the graduated scale of the first marking arrangement includes a center from which radii originate; and the graduated scale of the second marking arrangement includes longitudinal lines and transverse lines.

3. An assembly according to claim 1, wherein:

the graduated scale of the first marking arrangement includes a center from which radii originate and concentric circles having a center and various radii; and the graduated scale of the second marking arrangement includes longitudinal lines and a transverse line.

4. An assembly according to claim 1, wherein:

the graduated scale of the first marking arrangement includes a center from which radii originate and concentric circles having a center and various radii; and the graduated scale of the second marking arrangement includes a longitudinal line and transverse lines.

5. An assembly according to claim 1, wherein:

the receiving device comprises:

a lateral longitudinal portion which includes a lateral mounting base connected to a lateral flange;

a medial longitudinal portion which includes a medial mounting base connected to a medial flange;

a front strap extending between the lateral and medial flanges;

a rear strap extending between the lateral and medial flanges; and a rear support element adapted to support a rear of a user's lower leg.

6. An assembly according to claim 5, wherein:

the receiving device comprises a seat comprising only a single layer in the form of a pad.

7. An assembly according to claim 6, wherein:

the receiving device further comprises an opening extending through the seat;

the opening of the seat extends through a thickness of the pad;

a window is arranged in the area of the opening, the window bearing the graduated scale of the first marking arrangement; and the opening of the seat has a widening that forms a housing for the window.

8. An assembly according to claim 5, wherein:

the seat of the receiving device comprises a multilayered structure, said structure including a base extending between the medial and lateral flanges and a pad, the pad overlying the base.

9. An assembly according to claim 1, further comprising:

an optical device provided to cooperate with the first marking arrangement.

10. An assembly according to claim 1, further comprising:

a magnification lens provided to cooperate with the first marking arrangement.

11. An assembly according to claim 1, wherein:

the second marking arrangement is visible on an upper surface of the board.

12. An assembly according to claim 1, wherein:

the graduated scales of the first and second marking arrangements provide for marking positions of the receiving device in the longitudinal direction and at least one of the following: (a) a transverse direction and (b) an angular direction.

13. An assembly for the practice of a gliding or a rolling sport, said assembly comprising:

a board elongated in a longitudinal direction;

a receiving device for receiving a foot or a boot, said receiving device adapted to be mounted on the board;

a system for marking a position of the receiving device with respect to the board, the marking system comprising a first marking arrangement associated with the receiving device and a second marking arrangement associated with the board;

the first and second marking arrangements being configured and arranged to cooperate with one another in marking the position of the receiving device at which the receiving device is to be mounted on the board;

the receiving device comprising:

a seat provided to receive a boot sole;

an opening extending through the seat;

the first marking arrangement comprising the opening and a graduated scale arranged in an area of the opening; and the second marking arrangement comprising a graduated scale arranged on the board.

14. An assembly according to claim 13, wherein:

a window is arranged in the area of the opening, the window bearing the graduated scale of the first marking arrangement.

15. An assembly according to claim 14, further comprising:

a first window arranged in the opening of the seat, the window bearing the graduated scale of the first marking arrangement; and a complementary window spaced vertically from the first window, the first window and the complementary window demarcating boundaries of a closed volume.

16. An assembly according to claim 13, wherein:

the second marking arrangement is visible on an upper surface of the board.

17. An assembly according to claim 13, wherein:

the graduated scales of the first and second marking arrangements provide for marking positions of the receiving device in the longitudinal direction and at least one of the following: (a) a transverse direction and (b) an angular direction.

* * * * *